US010718591B2

(12) United States Patent
Tran

(10) Patent No.: US 10,718,591 B2
(45) Date of Patent: Jul. 21, 2020

(54) FOLDABLE BUTTSTOCK HAVING AIR TANK IN DIFFERENT POSITIONS FOR PNEUMATIC AIR GUN

(71) Applicant: Khanh Tran, Vista, CA (US)

(72) Inventor: Khanh Tran, Vista, CA (US)

(73) Assignee: Real Action Paintball Inc.

( * ) Notice: Subject to any disclaimer, the term of this patent is extended or adjusted under 35 U.S.C. 154(b) by 0 days.

(21) Appl. No.: 16/448,004

(22) Filed: Jun. 21, 2019

(65) Prior Publication Data

US 2019/0390933 A1 Dec. 26, 2019

Related U.S. Application Data

(60) Provisional application No. 62/688,401, filed on Jun. 22, 2018.

(51) Int. Cl.
*F41B 11/00* (2013.01)
*F41B 11/70* (2013.01)
*F41B 11/62* (2013.01)

(52) U.S. Cl.
CPC ..... *F41B 11/70* (2013.01); *F41B 11/62* (2013.01)

(58) Field of Classification Search
CPC ..... F41B 11/62; F41B 11/70; F41C 23/04
See application file for complete search history.

(56) References Cited

U.S. PATENT DOCUMENTS

| | | | | |
|---|---|---|---|---|
| 4,148,245 | A * | 4/1979 | Steffanus | F41A 1/04 89/7 |
| 6,553,707 | B1 * | 4/2003 | Tseng | F41B 11/00 124/27 |
| 7,065,914 | B1 * | 6/2006 | Wagner, II | F41B 11/00 124/74 |
| 9,605,924 | B1 * | 3/2017 | McCaslin | F41B 11/70 |
| 2017/0299321 | A1 * | 10/2017 | Lort | F41B 11/642 |
| 2018/0142984 | A1 * | 5/2018 | Harvey | F41B 11/721 |
| 2018/0202753 | A1 * | 7/2018 | Willson | F41B 11/55 |

FOREIGN PATENT DOCUMENTS

| | | | | |
|---|---|---|---|---|
| DE | 102015015522 | A1 * | 6/2017 | F41B 11/70 |

* cited by examiner

*Primary Examiner* — Gabriel J. Klein

(57) ABSTRACT

The present disclosure provides a foldable buttstock assembly for a pneumatic air gun. The foldable buttstock assembly has a foldable buttstock air fitting adapter connected to an air tank to a barrel unit of the pneumatic air gun. It also has an air channeling fitting to channel flow of the air gas. The pneumatic air gun can be operated while the air tank is in any position.

9 Claims, 2 Drawing Sheets

FOLDABLE BUTTSTOCK HAVING AIR TANK IN DIFFERENT POSITIONS FOR PNEUMATIC AIR GUN

CROSS-REFERENCE TO RELATED APPLICATIONS

Not Applicable

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

Field of the Invention

The present disclosure relates to the field of shooting sports. More particularly, the present disclosure relates to a foldable buttstock for a firearm.

Description of the Related Art

Typically firearms such as a pneumatic air gun are long profile rifles. In a pneumatic air gun, for example, an air tank is attached to the rear end, making it long profile rifle. The air tank is typically in a fixed position.

Such long profile rifles are difficult to transit. Also long profile rifles lack versatility making them unsuitable for close quarter shooting.

In light of the above discussion, there exists a need to make a long profile rifle convenient and easier to transit. Also, there is a need to make a long profile rifle suitable for close quarter shooting.

BRIEF SUMMARY OF THE INVENTION

In a first example, a foldable buttstock assembly for a pneumatic air gun is provided. The pneumatic air gun has an air tank and a barrel unit. The air tank has pressurized air gas. The foldable buttstock assembly allows pneumatic air gun to be operated while the air tank is in any position. The air tank can be in an open position such that pneumatic air gun has a long rifle profile. The air tank can be in a closed position such that pneumatic air gun has a short rifle profile. The air tank can be in an intermediate position such that pneumatic air gun has a profile shorter than a long rifle profile.

A primary object of the disclosure is to provide a foldable buttstock for a pneumatic air gun.

Another object of the present disclosure is to provide the foldable buttstock such that air tank of the pneumatic air gun can be folded in any direction.

Yet another object of the present disclosure is to provide the foldable buttstock that allows operation of the pneumatic air gun while the air tank is folded.

DESCRIPTION OF THE DRAWINGS

Figure 1:
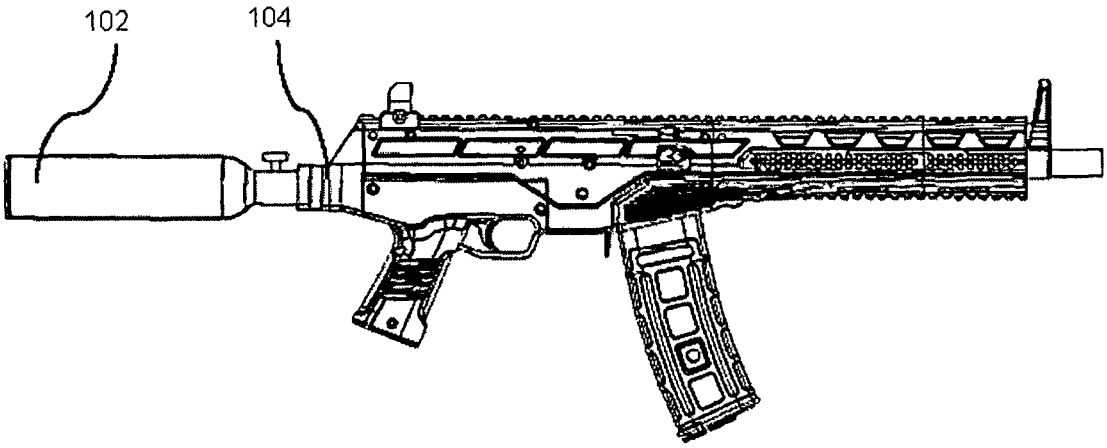
Figure 2:
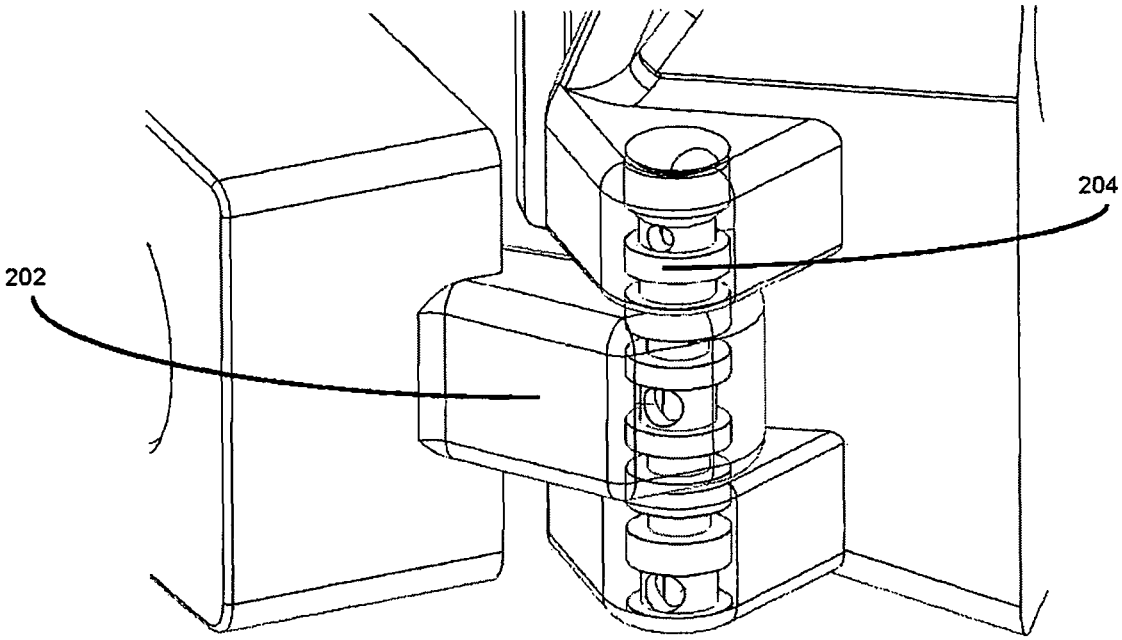
Figure 3:
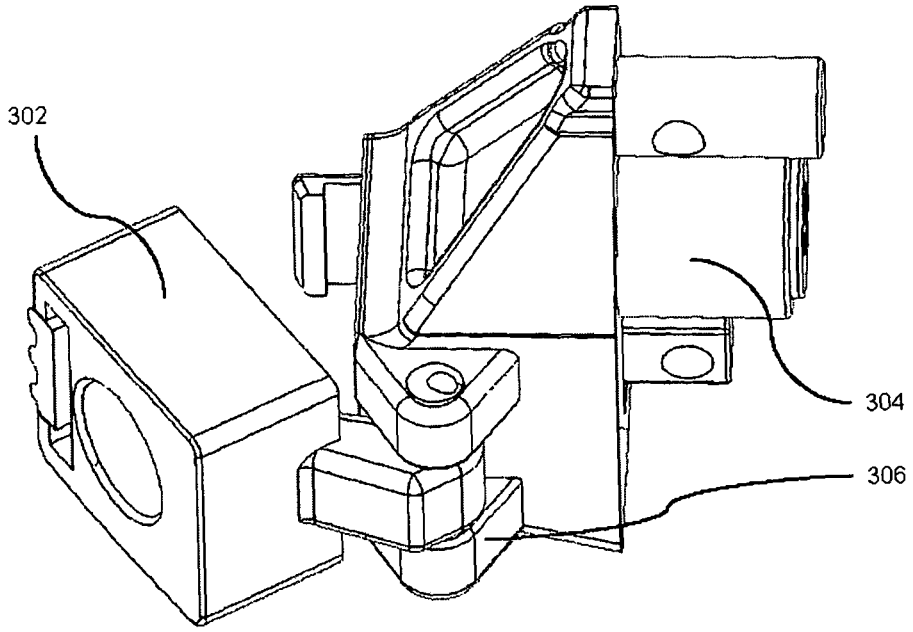
Figure 4:
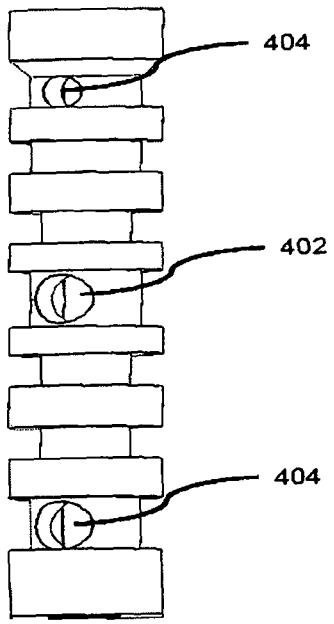

Having thus described the disclosure, in general, terms, reference will now be made to the accompanying figures, wherein:

FIG. 1 illustrates a pneumatic air gun, in accordance with an embodiment of the present disclosure;

FIG. 2 illustrates a foldable buttstock assembly, in accordance with an embodiment of the present disclosure;

FIG. 3 illustrates a foldable buttstock air fitting adapter, in accordance with an embodiment of the present disclosure; and FIG. 4 illustrates an air channeling fitting, in accordance with an embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

In the following description, for purposes of explanation, numerous specific details are set forth in order to provide a thorough understanding of the present disclosure. It will be apparent, however, to one skilled in the art that the present technology can be practiced without these specific details. In other instances, structures and devices are shown in block diagram form only in order to avoid obscuring the present disclosure.

Reference in this specification to "one embodiment" or "an embodiment" means that a particular feature, structure, or characteristic described in connection with the embodiment is included in at least one embodiment of the present technology. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Moreover, although the following description contains many specifics for the purposes of illustration, anyone skilled in the art will appreciate that many variations and/or alterations to said details are within the scope of the present technology. Similarly, although many of the features of the present technology are described in terms of each other, or in conjunction with each other, one skilled in the art will appreciate that many of these features can be provided independently of other features. Accordingly, this description of the present technology is set forth without any loss of generality to, and without imposing limitations upon, the present technology.

FIG. 1 illustrates a pneumatic air gun, in accordance with an embodiment of the present disclosure. The pneumatic air gun is has an air tank 102 and a barrel unit 104. The air tank 102 has pressurized air gas.

FIG. 2 illustrates the foldable buttstock assembly, in accordance with an embodiment of the present disclosure. The foldable buttstock assembly has a foldable buttstock air fitting adapter 202 and an air channeling fitting 204. The foldable buttstock air fitting adapter 202 mechanically connects the air tank to the barrel unit. The foldable buttstock air fitting adapter 202 is mechanically engaged with the air channeling fitting 204. The air channeling fitting 204 channels flow of the air gas from the air tank.

FIG. 3 illustrates the foldable buttstock air fitting adapter, in accordance with an embodiment of the present disclosure. The foldable buttstock air fitting adapter has a first adapter 302, a hinge arm 304 and a rotating hinge mechanism 306. The first adapter 302 is mechanically connected to the air tank such that it receives the air gas from the tank. Further the hinge arm 304 mechanically connects to the first adapter 302 and channels the air gas to the rotating hinge mechanism 306. The rotating hinge mechanism 306 is mechanically connects the first adapter 302 to the hinge arm 304 such that relative rotation is possible between the first adapter 302 and the hinge arm 304.

FIG. 4 illustrates the air channeling fitting, in accordance with an embodiment of the present disclosure. The air channeling fitting has one or more air fitting holes 402 that receive the air gas from the hinge arm. In an embodiment of the present disclosure, the one or more air fitting holes 402 is exactly one air fitting hole. Further the one or more air holes 404 channel the air gas to the barrel unit of the pneumatic air gun. In an embodiment of the present disclosure, the one or more air holes 404 are exactly two air holes. In yet an embodiment of the present disclosure, the one or more air holes 404 are exactly two air holes such that exactly one air hole receives the air gas from the one or more air fitting holes 402. In yet an embodiment of the present disclosure, the one or more air holes 404 are exactly two air holes such that both air hole receives the air gas from the one or more air fitting holes 402. This allows the pneumatic air gun to be operated while the air tank is in any position.

The descriptions of embodiments of the present disclosure and accompanying examples are presented for purposes of the purpose of understanding and clarity. They are not intended to be exhaustive or to limit the scope of the present disclosure to the precise forms disclosed. It will be understood to a person ordinarily skilled in the art that many variations are possible in light of the above disclosure.

What is claimed is:

1. A foldable buttstock assembly for a pneumatic air gun, wherein the pneumatic air gun has an air tank and a barrel unit, wherein the air tank has air gas, the foldable buttstock assembly comprising:

a foldable buttstock air fitting adapter mechanically connecting the air tank to the barrel unit, wherein the foldable buttstock air fitting adapter comprising:

a first adapter mechanically associated with the air tank, wherein the first adapter receives the air gas from the air tank;

a hinge arm mechanically connected to the first adapter, wherein the hinge arm channels the air gas; and a rotating hinge mechanism mechanically connecting the first adapter to the hinge arm such that relative rotation is enabled between the first adapter and the hinge arm; and an air channeling fitting mechanically engaged with the foldable buttstock air fitting adapter, wherein the air channeling fitting channels flow of the air gas, wherein the air channeling fitting comprising:

one or more air fitting holes receiving the air gas from the hinge arm; and one or more air holes receiving the air gas from the one or more air fitting holes, wherein the one or more air holes channels the air gas to the barrel unit of the pneumatic air gun, whereby the pneumatic air gun can shoot when the air tank is in any position.

2. The foldable buttstock assembly as recited in claim 1, wherein the one or more air fitting holes is exactly one air fitting hole.

3. The foldable buttstock assembly as recited in claim 1, wherein the one or more air holes are exactly two air holes.

4. The foldable buttstock assembly as recited in claim 1, wherein the one or more air holes are exactly two air holes such that exactly one air hole receives the air gas from the one or more air fitting holes.

5. The foldable buttstock assembly as recited in claim 1, wherein the one or more air holes are exactly two air holes such that exactly two air holes receive the air gas from the one or more air fitting holes.

6. A foldable buttstock assembly for a pneumatic air gun, wherein the pneumatic air gun has an air tank and a barrel unit, wherein the air tank has air gas, the foldable buttstock assembly comprising:

a foldable buttstock air fitting adapter mechanically connecting the air tank to the barrel unit, wherein the foldable buttstock air fitting adapter comprising:

a first adapter mechanically associated with the air tank, wherein the first adapter receives the air gas from the air tank;

a hinge arm mechanically connected to the first adapter, wherein the hinge arm channels the air gas; and a rotating hinge mechanism mechanically connecting the first adapter to the hinge arm such that relative rotation is enabled between the first adapter and the hinge arm; and an air channeling fitting mechanically engaged with the foldable buttstock air fitting adapter, wherein the air channeling fitting channels flow of the air gas, wherein the air channeling fitting comprising:

an air fitting hole receiving the air gas from the hinge arm; and two air holes receiving the air gas from the air fitting hole, wherein the two air holes channels the air gas to the barrel unit of the pneumatic air gun, whereby the pneumatic air gun can shoot when the air tank is in any position.

7. The foldable buttstock assembly as recited in claim 6, wherein the one or more air holes are exactly two air holes such that exactly one air hole receives the air gas from the air fitting hole.

8. The foldable buttstock assembly as recited in claim 6, wherein the one or more air holes are exactly two air holes such that exactly two air holes receive the air gas from the air fitting hole.

9. A foldable buttstock assembly for a pneumatic air gun, wherein the pneumatic air gun has an air tank and a barrel unit, wherein the air tank has air gas, the foldable buttstock assembly comprising:

a foldable buttstock air fitting adapter mechanically connecting the air tank to the barrel unit, wherein the foldable buttstock air fitting adapter comprising:

a first adapter mechanically associated with the air tank, wherein the first adapter receives the air gas from the air tank;

a hinge arm mechanically connected to the first adapter, wherein the hinge arm channels the air gas; and a rotating hinge mechanism mechanically connecting the first adapter to the hinge arm such that relative rotation is enabled between the first adapter and the hinge arm; and an air channeling fitting mechanically engaged with the foldable buttstock air fitting adapter, wherein the air channeling fitting channels flow of the air gas, wherein the air channeling fitting comprising:

an air fitting hole receiving the air gas from the hinge arm; and two air holes receiving the air gas from the air fitting hole, wherein the two air holes channels the air gas to the barrel unit of the pneumatic air gun, wherein at least one air hole of the two air holes receives the air gas from the air fitting hole, whereby the pneumatic air gun can shoot when the air tank is in any position.

* * * * *